US008663455B2

(12) United States Patent
Levine et al.

(10) Patent No.: US 8,663,455 B2
(45) Date of Patent: Mar. 4, 2014

(54) ADDITION OF HIGH MOLECULAR WEIGHT NAPHTHENIC TETRA-ACIDS TO CRUDE OILS TO REDUCE WHOLE CRUDE OIL FOULING

(75) Inventors: Steven W. Levine, Flemington, NJ (US); Glen B. Brons, Phillipsburg, NJ (US); George A. Lutz, Brick, NJ (US); Daniel P. Leta, Flemington, NJ (US); Clifford C. Walters, Milford, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 723 days.

(21) Appl. No.: 12/631,232

(22) Filed: Dec. 4, 2009

(65) Prior Publication Data

US 2010/0147739 A1 Jun. 17, 2010

Related U.S. Application Data

(60) Provisional application No. 61/193,621, filed on Dec. 11, 2008.

(51) Int. Cl.
*C10G 75/04* (2006.01)
*C10G 9/16* (2006.01)

(52) U.S. Cl.
USPC ..... 208/48 AA; 208/47; 208/48 R

(58) Field of Classification Search
USPC ..... 208/47, 48 R, 48 AA, 106, 125, 131, 208/132, 347
See application file for complete search history.

(56) References Cited

U.S. PATENT DOCUMENTS

| | | | | |
|---|---|---|---|---|
| 5,468,367 | A | 11/1995 | Dickaklan | |
| 2005/0139238 | A1 * | 6/2005 | Ferrara | 134/22.11 |
| 2007/0144631 | A1 | 6/2007 | Clavenna et al. | |
| 2007/0158054 | A1 | 7/2007 | Greaney et al. | |
| 2007/0267175 | A1 | 11/2007 | Yeganeh et al. | |
| 2007/0267176 | A1 | 11/2007 | Song et al. | |
| 2007/0298505 | A1 * | 12/2007 | Smith et al. | 436/61 |
| 2008/0041762 | A1 * | 2/2008 | Brons et al. | 208/18 |
| 2008/0073063 | A1 | 3/2008 | Clavenna et al. | |

FOREIGN PATENT DOCUMENTS

| | | | |
|---|---|---|---|
| EP | 1840567 | A1 | 3/2007 |
| WO | 2008068624 | A2 | 6/2008 |

OTHER PUBLICATIONS

Mediaas, Heidi et al. "Efficient Management of Calcium Naphthenate Deposition at Oil Fields", TEKNA—Separation Technology 2007 (Sep. 26-27, 2007).*
Search Report issued Aug. 31, 2012 in corresponding Singapore Application No. 201103566-4, 5 pps.
Written Opinion issued Aug. 31, 2012 in corresponding Singapore Application No. 201103566-4, 6 pps.

(Continued)

*Primary Examiner* — Renee E Robinson
(74) *Attorney, Agent, or Firm* — Glenn T. Barrett; Malcolm D. Keen

(57) ABSTRACT

High molecular weight naphthenic tetra-acids are added to a base crude oil to prevent and/or reduce fouling of crude oil refinery equipment. The method includes adding an effective amount of a high molecular weight naphthenic tetra-acid to the base crude oil to form a crude oil mixture and feeding the crude oil mixture to a crude oil refinery component. Particularly, the high molecular weight naphthenic tetra-acids include ARN acids.

14 Claims, 4 Drawing Sheets

(56) References Cited

OTHER PUBLICATIONS

Headley et al., "Characterization of Naphthenic Acids from Athabasca Oil Sands Using Electrospray Ionization: The Significant Influence of Solvents", Analytical Chemistry, vol. 79, No. 16, pp. 6222-6229, Aug. 15, 2007.

Varadaraj et al., "Molecular Origins of Heavy Crude Oil Interfacial Activity Part 2: Fundamental Interfacial Properties of Model Naphthenic Acids and Naphthenic Acids Separated from Heavy Crude Oils", Energy & Fuels, vol. 21, No. 1, pp. 199-204, Dec. 14, 2006.

Shepard et al., "SPE 157295—Flow Assurance in Oil Systems: On the Role and Impact of Naphthenic Acids", SPE International, SPE International Production and Operatiosn Conference and Exhibition, Doha, Qatar, May 14-16, 2012.

Lutnaes et al., "Archaeal C80 Isoprenoid Tetraacids Responsible for Naphthenate Deposition in Crude Oil Processing", Organic and Biomolecular Chemistry, vol. 4, pp. 616-620 (2006).

Baugh et al., "The Discovery of High-Molecular-Weight Naphthenic Acids (ARN Acid) Responsible for Calcium Naphthenate Deposits", Society of Petroleum Engineers 93011, pp. 1-7 (2005).

* cited by examiner

ADDITION OF HIGH MOLECULAR WEIGHT NAPHTHENIC TETRA-ACIDS TO CRUDE OILS TO REDUCE WHOLE CRUDE OIL FOULING

CROSS REFERENCE TO RELATED APPLICATION

The application relates and claims priority to U.S. Provisional Patent Application No. 61/193,621, filed on Dec. 11, 2008.

FIELD OF THE INVENTION

The disclosed subject matter relates to processing of whole crude oils, blends and fractions in refineries and petrochemical plants. In particular, the disclosed subject matter relates to the reduction crude oil fouling by adding high molecular weight naphthenic tetra-acids to base crude oils to reduce fouling in refinery process units.

BACKGROUND OF THE INVENTION

Fouling is generally defined as the accumulation of unwanted materials on the surfaces of processing equipment. In petroleum processing, fouling is the accumulation of unwanted hydrocarbon-based deposits on heat exchanger surfaces. It has been recognized as a nearly universal problem in design and operation of refining and petrochemical processing systems, and affects the operation of equipment in two ways. First, the fouling layer has a low thermal conductivity. This increases the resistance to heat transfer and reduces the effectiveness of the heat exchangers. Second, as deposition occurs, the cross-sectional area is reduced, which causes an increase in pressure drop across the apparatus and creates inefficient pressure and flow in the heat exchanger.

Fouling in heat exchangers associated with petroleum type streams can result from a number of mechanisms including chemical reactions, corrosion, deposit of insoluble materials, and deposit of materials made insoluble by the temperature difference between the fluid and heat exchange wall. For example, the inventors have shown that a low-sulfur, low asphaltene (LSLA) crude oil and a high-sulfur, high asphaltene (HSHA) crude blend are subject to a significant increase in fouling when in the presence of iron oxide (rust) particulates, as shown for example in FIGS. 1 and 2.

One of the more common root causes of rapid fouling, in particular, is the formation of coke that occurs when crude oil asphaltenes are overexposed to heater tube surface temperatures. The liquids on the other side of the exchanger are much hotter than the whole crude oils and result in relatively high surface or skin temperatures. The asphaltenes can precipitate from the oil and adhere to these hot surfaces. Another common cause of rapid fouling is attributed to the presence of salts and particulates. Salts/particulates can precipitate from the crude oils and adhere to the hot surfaces of the heat exchanger. Inorganic contaminants play both an initiating and promoting role in the fouling of whole crude oils and blends. Iron oxide, calcium carbonate, silica, sodium and calcium chlorides have all been found to be attached directly to the surface of fouled heater rods and throughout the coke deposit.

Prolonged exposure to such surface temperatures, especially in the late-train exchangers, allows for the thermal degradation of the organics and asphaltenes to coke. The coke then acts as an insulator and is responsible for heat transfer efficiency losses in the heat exchanger by preventing the surface from heating the oil passing through the unit. Salts, sediment and particulates have been shown to play a major role in the fouling of pre-heat train heat exchangers, furnaces and other downstream units. Desalter units are still the only opportunity refineries have to remove such contaminants and inefficiencies often result from the carryover of such materials with the crude oil feeds.

Blending of oils in refineries is common, but certain blends are incompatible and cause precipitation of asphaltenes that can rapidly foul process equipment. Improper mixing of crude oils can produce asphaltenic sediment that is known to reduce heat transfer efficiency. Although most blends of unprocessed crude oils are not potentially incompatible, once an incompatible blend is obtained, the rapid fouling and coking that results usually requires shutting down the refining process in a short time. To return the refinery to more profitable levels, the fouled heat exchangers need to be cleaned, which typically requires removal from service, as discussed below.

Heat exchanger in-tube fouling costs petroleum refineries hundreds of millions of dollars each year due to lost efficiencies, throughput, and additional energy consumption. With the increased cost of energy, heat exchanger fouling has a greater impact on process profitability. Petroleum refineries and petrochemical plants also suffer high operating costs due to cleaning required as a result of fouling that occurs during thermal processing of whole crude oils, blends and fractions in heat transfer equipment. While many types of refinery equipment are affected by fouling, cost estimates have shown that the majority of profit losses occur due to the fouling of whole crude oils, blends and fractions in pre-heat train exchangers.

Heat exchanger fouling forces refineries to frequently employ costly shutdowns for the cleaning process. Currently, most refineries practice off-line cleaning of heat exchanger tube bundles by bringing the heat exchanger out of service to perform chemical or mechanical cleaning. The cleaning can be based on scheduled time or usage or on actual monitored fouling conditions. Such conditions can be determined by evaluating the loss of heat exchange efficiency. However, off-line cleaning interrupts service. This can be particularly burdensome for small refineries because there will be periods of non-production.

Naphthenic acids are carboxylic acids that occur in most crude oils as trace components and in some, biodegraded oils in significantly greater concentrations. Total acids in crude oils is semi-quantified by titration with KOH and expressed in terms of total acid number (TAN). The acidity of high TAN oils may cause emulsion and corrosion problems in both production and refining. Solid deposits recently identified as sodium and calcium naphthenates can result in substantial damage and loss of production.

Under certain conditions, the naphthenic acids present in acidic crude oil will precipitate with $Ca^{2+}$ ions that are present in the co-produced water to form calcium naphthenate solids. Other cations are involved to a lesser extent forming a variety of metal naphthenates (e.g., sodium, ferrous iron and magnesium). This solid precipitation accumulates predominantly in oil-water separators and desalters, but naphthenates can also deposit in the tube and pipelines.

A great deal of research has been pursued to characterize the naphthenic acid responsible for the calcium deposits. It has been recently found that a specific family of high molecular weight tetracarboxylic acids, termed ARN Acids, is the major constituents responsible for the calcium naphthenate deposits (ARN is not an acronym, but is Old Norwegian for "eagle"). ARN acids are high molecular weight molecules with four carboxylic acid groups, each at the end of a long aliphatic chain, forming a four-fingered molecule with polar tips. The ARN acids are a specific family of ~$C_{80}$ tetracarboxylic acids. A majority of the ARN acids have a molecular weight ranging from about 1228 to about 1236 atomic mass units (amu) with one of the main acids having a molecular weight of 1232 amu and a molecular formula of $C_{80}H_{142}O_8$. The ARN acids do not have an aromatic or alkene function present and quaternary carbons do not exist. The ARN acids can have 4-8 sites of unsaturation (or 4-8 cyclopentyl rings) and are believed to be derived from archaeal $C_{80}$ lipids.

The proposed structure of a major ARN acid with mass 1232 is 6:17,10:18,10':18',6":17",10":18",10":18")-hexacyclo-20-bis-16,16"-biphytane-1,1',1",1'"-tetracarboxylic acid. The molecule contains two biphytanyl diacids, each with three pentacyclic rings joined together by a linkage at the $C_{20}$ methyl groups, as described in Lutnaes B. F., Brandal Ø., Sjöblom J., and Krane J. (2006) Archaeal $C_{80}$ isoprenoid tetraacids responsible for naphthenate deposition in crude oil processing. *Organic & Biomolecular Chemistry* 4, 616-620, incorporated by reference in its entirety herein.

A representative structure of an archaeal $C_{80}$ isoprenoid tetra-acid is shown below:

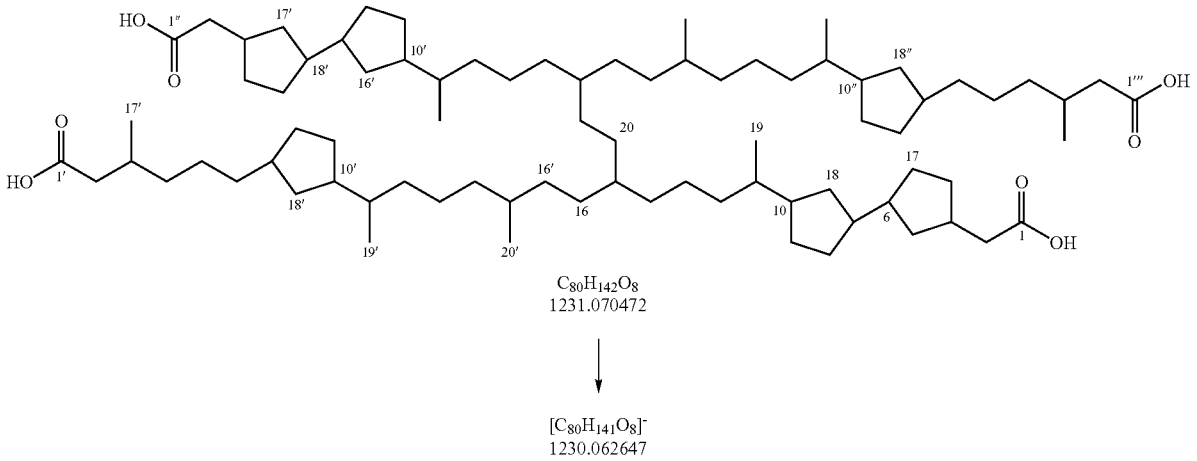

The four carboxylic acid groups afford the molecule's unusually high reactivity. The four carboxylic groups tend to create polymeric salt when they are coordinated with divalent metal ions. This weaved polymeric-like structure yields a very sticky deposit that hardens upon contact with air.

The need exists to be able to prevent the precipitation/adherence of particulates and asphaltenes from the heated surfaces before the particulates can promote fouling and the asphaltenes become thermally degraded or coked. The coking mechanism requires both temperature and time. The time factor can be greatly reduced by keeping the particulates away from the surface and by keeping the asphaltenes in solution. Such reduction and/or elimination of fouling will lead to increased run lengths (less cleaning), improved performance and energy efficiency while also reducing the need for costly fouling mitigation options.

SUMMARY OF THE INVENTION

The purpose and advantages of the disclosed subject matter will be set forth in and apparent from the description that follows, as well as will be learned by practice of the invention. Additional advantages of the invention will be realized and attained by the methods and systems particularly pointed out in the written description and claims hereof, as well as from the appended drawings.

To achieve these and other advantages and in accordance with one aspect of the invention, as embodied and broadly described, the invention includes a method for reducing fouling in a crude oil refinery component. The method includes the steps of providing a base crude oil; providing a high molecular weight naphthenic tetra-acid; adding an effective amount of the high molecular weight naphthenic tetra-acid to the base crude oil to form a crude oil mixture; and feeding the crude oil mixture to a crude oil refinery component. The base crude oil can be one of a whole crude oil or a blend of at least two crude oils. The crude oil refinery component can be a heat exchanger, furnace, distillation column, scrubber, reactor, liquid-jacketed tank, pipestill, coker, or visbreaker.

The addition of an effective amount of high molecular weight naphthenic tetra-acid to the base crude preferably reduces fouling by at least 30 percent. The effective amount of the high molecular weight naphthenic tetra-acid in one embodiment is between about 50 and about 1000 parts per million by weight (wppm.) Preferably, the high molecular weight naphthenic tetra-acid is an ARN acid having an atomic molecular weight greater than 1230 atomic mass units (amu). In accordance with another embodiment, the high molecular weight naphthenic tetra-acid is extracted from a calcium naphthenate salt. The calcium naphthenate acid can be extracted from calcium naphthenate deposits, the deposits occurring from the production of a crude oil.

Another aspect of the disclosed subject matter includes a method for on-line cleaning of a fouled crude oil refinery component by operating a fouled crude oil refinery component and feeding a crude oil mixture to the fouled crude oil refinery component. The crude oil mixture includes a base crude oil and an effective amount of a high molecular weight naphthenic tetra-acid. The effective amount of a high molecular weight naphthenic tetra-acid is between about 100 and 500 parts per million by weight.

According to another aspect, the disclosed subject matter includes a system capable of experiencing fouling conditions associated with particulate or asphaltene fouling. The system includes at least one crude oil refinery component, and a mixture in fluid communication with the crude oil refinery component, the mixture including a base crude oil and an effective amount of a high-molecular weight naphthenic tetra-acid. In accordance with one embodiment, the crude oil is a high neutralization number (HNN) crude oil. The FINN crude oil can be a high solvency dispersive power (HSDP) oil.

According to another aspect, the disclosed subject matter includes a crude oil with increased fouling mitigation, the crude oil including a base crude oil and an effective amount of a high molecular weight naphthenic tetra-acid. The effective amount of the high molecular weight naphthenic tetra-acid is between about 100 and about 500 parts per million by weight (wppm). The high molecular weight naphthenic tetra-acid can be an ARN acid. Particularly, in accordance with one embodiment, typical ARN acids are archaeal $C_{80}$ isoprenoids. In one embodiment, ARN acids can have molecular weights ranging from about 1228 to about 1236 atomic mass units (amu). In another embodiment, ARN acids have atomic molecular weights greater than about 1230 atomic mass units (amu). The present invention is not intended to be limited to these examples; rather, various high molecular weight naphthenic tetra-acids with varying atomic molecular weights are considered to be well within the scope of the present invention.

According to another aspect, the disclosed subject matter includes a process for making a crude oil with increased fouling mitigation or on-line cleaning effects, the process comprising providing a base crude oil and adding an effective amount of a high molecular weight naphthenic tetra-acid to the base oil to form the crude oil mixture.

These and other features of the disclosed subject matter will become apparent from the following detailed description of preferred embodiments which, taken in conjunction with the accompanying drawings, illustrate by way of example the principles of the disclosed subject matter.

BRIEF DESCRIPTION OF THE DRAWINGS

The disclosed subject matter will now be described in conjunction with the accompanying drawings in which.

DETAILED DESCRIPTION

Figure 1:
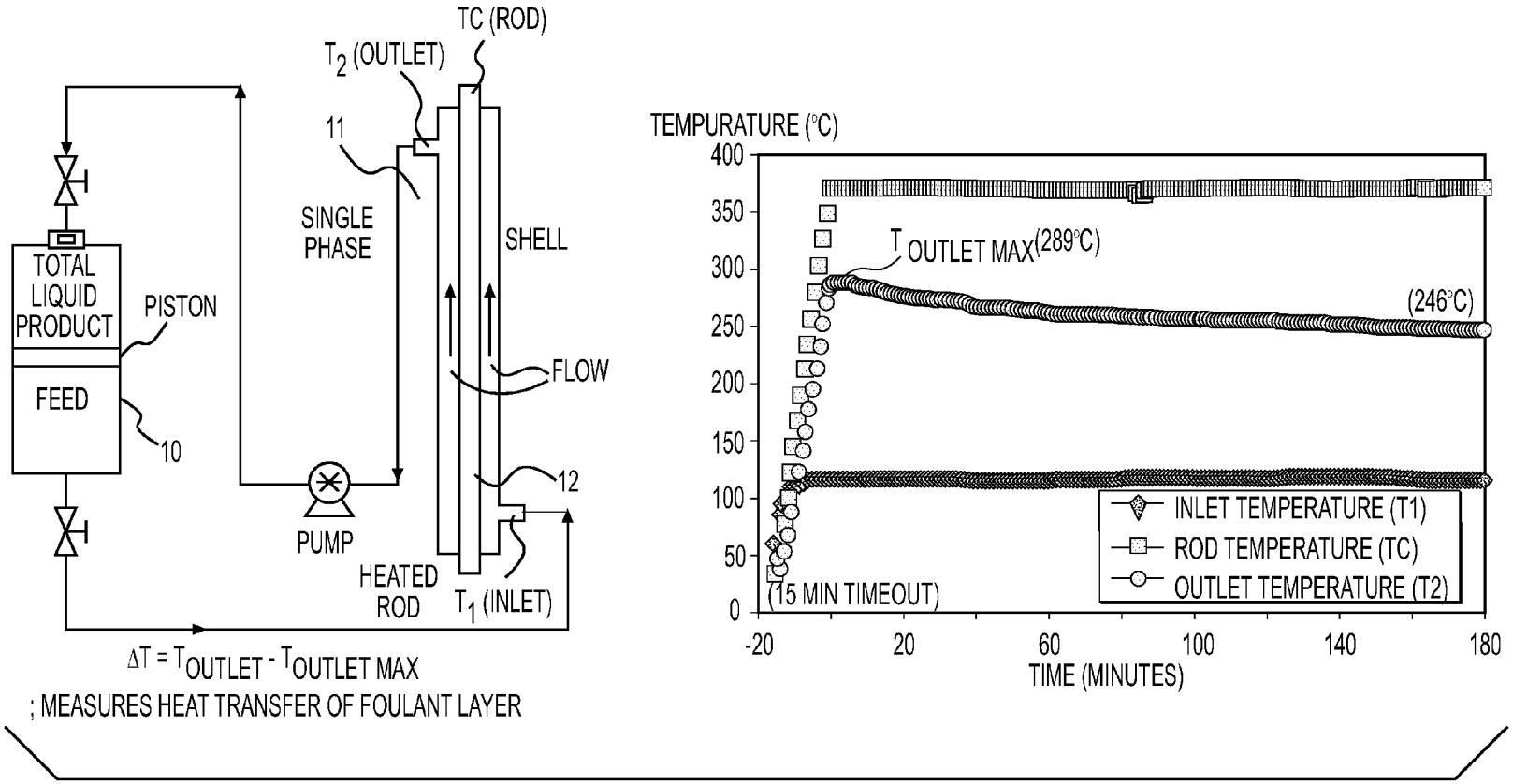
FIG. 1 is a schematic of an Alcor Hot Liquid Process Simulator (AHLPS) used in accordance with the disclosed subject matter.

Reference will now be made in detail to the various aspects of the disclosed subject matter. The method and corresponding steps of the invention will be described in conjunction with the figures and examples provided herein.

In accordance with the disclosed subject matter, a method for reducing fouling in crude oil refinery is provided. This reduction in fouling is achieved by adding a high molecular weight naphthenic tetra-acid to a base crude oil and feeding this mixture to a crude oil refinery component. The crude oil mixture including an effective amount of a high molecular weight naphthenic tetra-acid and a base crude oil exhibits a significant reduction in fouling. This results in improved heat transfer and flow within crude oil refinery components, such as, for example, a heat exchanger. Alternatively, a blending crude oil containing a high molecular weight naphthenic tetra-acid may be used. The blending crude containing the acid is blended with a base crude oil before the blended feedstock is fed to the crude oil refinery component.

Alternatively or additionally, a method is also provided for on-line cleaning of a fouled crude oil refinery component. The method includes operating a fouled crude oil refinery component and feeding a blended crude oil to the fouled refinery component. The blended crude oil includes a blend of a base crude oil and an effective amount of a high-molecular weight naphthenic tetra-acid. Particularly, high-molecular weight naphthenic tetra-acids can be added to blended crude oil—to perform on-line cleaning of already fouled crude preheat train exchangers and other refinery components to improve heat transfer efficiencies and recovered furnace coil-inlet-temperatures (CITs). The crude oil mixture including the high-molecular weight naphthenic tetra-acids can also be flushed through heat exchange equipment to remove any deposits and/or precipitates on a regular maintenance schedule before coking can affect heat exchanger surfaces. The improvement in heat transfer efficiencies results in energy savings and environmental benefits.

Generally, the base crude oil can consist of a whole crude oil, a blend of two or more crude oils or fractions thereof. The addition of high molecular weight naphthenic tetra-acids to the base crude oil is effective in reducing fouling in a crude oil refinery component. A crude oil refinery component generally refers to an apparatus or instrumentality of a process to refine crude hydrocarbons, such as an oil refinery process, which is, or may be, susceptible to fouling. Crude oil refinery components include, but are not limited to, heat transfer components such as a heat exchanger, a furnace, a crude preheater, a coker preheater, or any other heaters, a FCC slurry bottom, a debutanizer exchanger/tower, other feed/effluent exchangers and furnace air preheaters in refinery facilities, flare compressor components in refinery facilities and steam cracker/reformer tubes in petrochemical facilities. Crude oil refinery components can also include other instrumentalities in which heat transfer may take place, such as a fractionation or distillation column, a scrubber, a reactor, a liquid-jacketed tank, a pipestill, a coker and a visbreaker. It is understood that crude oil refinery components can also encompasses tubes, piping, baffles and other process transport mechanisms that are internal to, at least partially constitute, and/or are in direct fluid communication with, any one of the above-mentioned crude hydrocarbon refinery components.

While not limited thereto, the addition of a high molecular weight naphthenic tetra-acid is particularly suitable in reducing or preventing particulate-induced fouling and/or asphaltene fouling. Particulate-induced fouling generally refers to fouling caused primarily by the presence of variable amounts of organic or inorganic particulates. Organic particulates (such as precipitated asphaltenes and coke particles) include, but are not limited to, insoluble matter precipitated out of solution upon changes in process conditions (e.g. temperature, pressure, or concentration changes) or a change in the composition of the feed stream (e.g. changes due to the occurrence of a chemical reaction). Inorganic particulates include, but are not limited to, silica, iron oxide, iron sulfide, alkaline earth metal oxides, sodium chloride, calcium chloride and other inorganic salts. One major source of these particulates results from incomplete solids removal during desalting and/or other particulate removing processes. Solids promote the fouling of crude oils and blends due to physical effects by modifying the surface area of the heat transfer equipment, allowing for longer holdup times at wall temperatures and causing coke formation from asphaltenes and/or crude oil(s).

The high molecular weight naphthenic tetra-acids can be added to crude oils which contain particulates, including organic and inorganic particulates as defined above. The crude oil can contain any amount of such particulates.

An effective amount of the high molecular weight naphthenic tetra-acid reduces or prevents particulate induced fouling. The presence of the high molecular weight naphthenic tetra-acids prevents or reduces the amount of particulates in the base crude oil from adhering to the surfaces of the crude oil refinery equipment or component, thereby mitigating the particulates impact on the promotion of fouling.

Generally, but not by limitation, the high molecular weight naphthenic tetra-acid is a molecule with four carboxylic acid groups, each at the end of a long aliphatic chain, forming a four-fingered molecule with polar tips. In accordance with one embodiment, the high molecular weight naphthenic tetra-acid has an atomic molecular weight greater than 1230 atomic mass units (amu).

For example, and in accordance with one embodiment, the high molecular weight naphthenic tetra-acid is an ARN acid. ARN acids are a specific family of ~$C_{80}$ tetracarboxylic acids. A majority of the ARN acids have a molecular weight ranging from about 1228 to about 1236 atomic mass units (amu) with one of the main acids having a molecular weight of 1232 amu. The ARN acids do not have an aromatic or alkene function present and quaternary carbons do not exist. The ARN acids can have 4-8 sites of unsaturation (or 4-8 cyclopentyl rings).

For purpose of illustration and not limitation, the ARN acid can be the archaeal $C_{80}$ isoprenoid, whose empirical formula is $C_{80}H_{142}O_8$ and whose structure is 6:17,10:18,10':18',6":17",10":18",10":18")-hexacyclo-20-bis-16,16"-biphytane-1,1',1",1'"-tetracarboxylic acid. This $C_{80}$ isoprenoid molecule contains two biphytanyl diacids, each with three pentacyclic rings joined together by a linkage at the $C_{20}$ methyl groups and its structure is represented by:

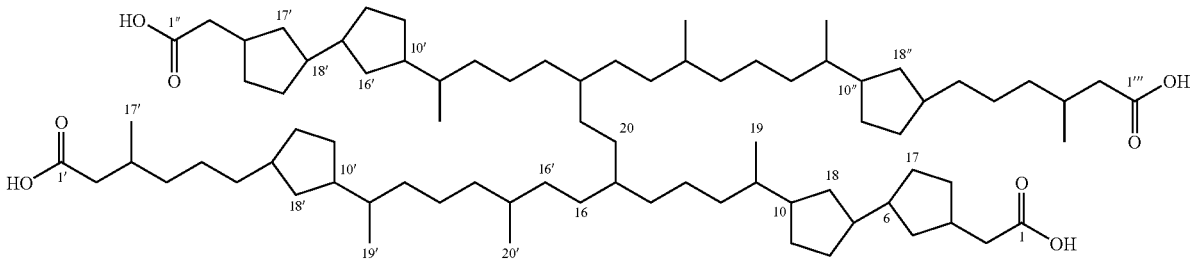

$C_{80}H_{142}O_8$
1231.070472

↓

$[C_{80}H_{141}O_8]^-$
1230.062647

Under certain conditions, the naphthenic acids present in acidic crude oil will precipitate with $Ca^{2+}$ ions that are present in the co-produced water to form calcium naphthenate deposits. High molecular weight naphthenic tetra-acids are responsible for calcium naphthenate deposits occurring during the production of some crude oils. Therefore, the high molecular weight naphthenic tetra-acid used in the disclosed subject matter can be extracted from the calcium naphthenate deposits, the deposits including high molecular weight naphthenic tetra-acid calcium salts. Suitable methods for extracting or isolating high molecular weight naphthenic tetra-acids from calcium naphthenate deposits, particularly from the calcium naphthenate salts contained in the deposits, are described in U.S. Provisional Application No. 61/193,791 filed on Dec. 23, 2008. Typically, calcium naphthenate deposits occur during the production of high neutralization number (HNN) crude oils.

Alternatively, the high molecular weight naphthenic tetra-acid can be extracted directly from a calcium naphthenate salt.

In accordance with the invention, an amount of the high molecular weight naphthenic acid effective to reduce fouling in a crude oil refinery component is added to the base crude oil. Generally, the effective amount of the high molecular weight naphthenic tetra-acid is at least 50 parts per million by weight (wppm), although the effective amount will depend upon the base crude oil and the amount of particulates present in the base crude oil.

In accordance with one aspect of the invention, the high molecular weight naphthenic tetra-acid is added to the base crude oil prior to being introduced to the refining process, or at the very beginning of the refining process. Alternatively, the high molecular weight naphthenic tetra-acid may be contained in a crude oil, which is blended with the base crude oil prior to introduction to the refining process. Alternatively, the high molecular weight naphthenic tetra-acid can be introduced, for example at any suitable location, upstream from the particular crude hydrocarbon refinery component(s) in which it is desired to reduce or prevent fouling. Any suitable technique for introduction of the high molecular weight naphthenic tetra-acid can be used. The high molecular weight naphthenic tetra-acid can be added to the base crude oil, alone or in combination with other compounds and/or additives that contribute to either reduce fouling or improve some other process parameter in order to optimize the refining process.

Furthermore, it is contemplated that the addition of a high-molecular weight naphthenic tetra-acid, particularly an ARN acid to a base crude oil, as described in connection with the disclosed subject matter, can be combined with other techniques for reducing and/or mitigating fouling. Such techniques include, but are not limited to, (i) the provision of low energy surfaces and modified steel surfaces in heat exchanger tubes, as described in U.S. patent application Ser. Nos. 11/436,602 and 11/436,802, the disclosures of which are incorporated in their entirety herein specifically by reference, (ii) the use of controlled mechanical vibration, as described in U.S. patent application Ser. No. 11/436,802, the disclosure of which is incorporated herein in its entirety specifically by reference (iii) the use of fluid pulsation and/or vibration, which can be combined with surface coatings, as described in U.S. patent application Ser. No. 11/802,617, filed on Jun. 19, 2007, entitled "Reduction of Fouling in Heat Exchangers," the disclosure of which is incorporated herein in its entirety specifically by reference (iv) the use of electropolishing on heat exchanger tubes and/or surface coatings and/or modifications, as described in U.S. patent application Ser. No. 11/641,754, the disclosure of which is incorporated herein in its entirety specifically by reference and (v) combinations of the same, as described in U.S. patent application Ser. No. 11/641,755, filed on Dec. 20, 2006, entitled "A Method of Reducing Heat Exchanger Fouling in a Refinery," the disclosure of which is incorporated herein in its entirety specifically by reference. Thus, it is intended that the disclosed subject matter covers the modifications and variations of the method herein, provided they come within the scope of the appended claims and their equivalents.

Based upon the description above, it is evident that the disclosed subject matter herein also includes a crude oil with increased fouling mitigation, wherein the crude oil comprises at least a base crude oil and an effective amount of a high molecular weight naphthenic tetra-acid. Similarly, a process for making such a crude oil with increased fouling mitigation or on-line cleaning effects is disclosed, which includes providing a base crude oil and adding an effective amount of a high molecular weight naphthenic tetra-acid to the base oil to form the crude oil mixture. Additional aspects and details of the crude oil and process for making such a crude oil are described above.

For example, and in accordance with yet another aspect of the disclosed subject matter, a system is provided that is capable of experiencing fouling conditions associated with particulate or asphaltene fouling. The system includes at least one crude oil refinery component, and a mixture in fluid communication with the crude oil refinery component, the mixture including a base crude oil and an effective amount of a high-molecular weight naphthenic tetra-acid. Additional aspects and details of such a system are described above.

While a particular form of the invention has been described, it will be apparent to those skilled in the art that various modifications can be made without departing from the spirit and scope of the invention.

EXAMPLES

The present application is further described by means of the examples, presented below. The use of such examples is illustrative only and in no way limits the scope and meaning of the invention or of any exemplified term.

Example 1

An Alcor HLPS (Hot Liquid Process Simulator) testing apparatus is used to measure what the impact the addition of particulates to a crude oil has on fouling and what impact the addition of a high-molecular weight naphthenic tetra-acid has on the reduction and mitigation of fouling. As illustrated in FIG. 1, the testing arrangement includes a reservoir 10 containing a feed supply of crude oil. The feed supply of crude oil may contain a base crude oil containing a whole crude or a blended crude containing two or more crude oils. The feed supply is heated to a temperature of approximately 150° C./302° F. and then fed into a shell 11 containing a vertically oriented heated rod 12. The heated rod 12 is formed from carbon-steel (1018). The heated rod 12 simulates a tube in a heat exchanger. The heated rod 12 is electrically heated to a surface temperature of 370° C./698° F. or 400° C./752° F. and maintained at such temperature during the trial. The feed supply is pumped across the heated rod 12 at a flow rate of approximately 3.0 mL/minute. The spent feed supply is collected in the top section of the reservoir 10. The spent feed supply is separated from the untreated feed supply oil by a sealed piston, thereby allowing for once-through operation. The system is pressurized with nitrogen (400-500 psig) to ensure gases remain dissolved in the oil during the test. Thermocouple readings are recorded for the bulk fluid inlet and outlet temperatures and for surface of the rod 12.

During the constant surface temperature testing, foulant deposits and builds up on the heated surface. The foulant deposits are thermally degraded to coke. The coke deposits cause an insulating effect that reduces the efficiency and/or ability of the surface to heat the oil passing over it. The resulting reduction in outlet bulk fluid temperature continues over time as fouling continues. This reduction in temperature is referred to as the outlet liquid ΔT or dT and can be dependent on the type of crude oil/blend, testing conditions and/or other effects, such as the presence of salts, sediment or other fouling promoting materials. A standard Alcor fouling test is carried out for 180 minutes. The total fouling, as measured by the total reduction in outlet liquid temperature over time, is referred to as ΔT180 or dt180 and is the observed outlet temperature ($T_{outlet}$) minus the maximum observed outlet $T_{outlet\ max}$ (presumably achieved in the absence of any fouling).

Figure 2:
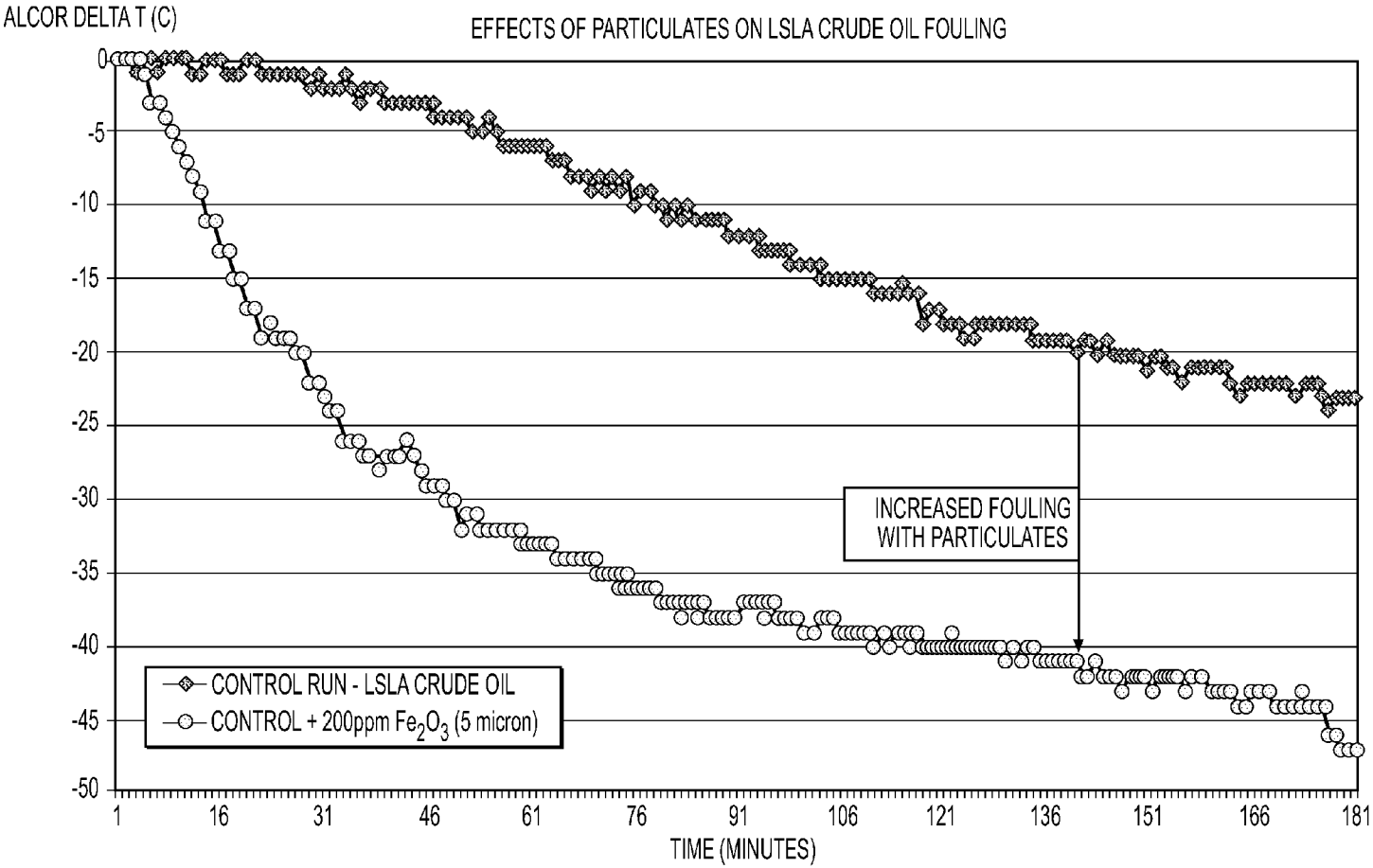
FIG. 2 is a graph illustrating the effects of particulates on fouling of a low-sulfur, low asphaltene (LSLA) crude oil.
Figure 3:
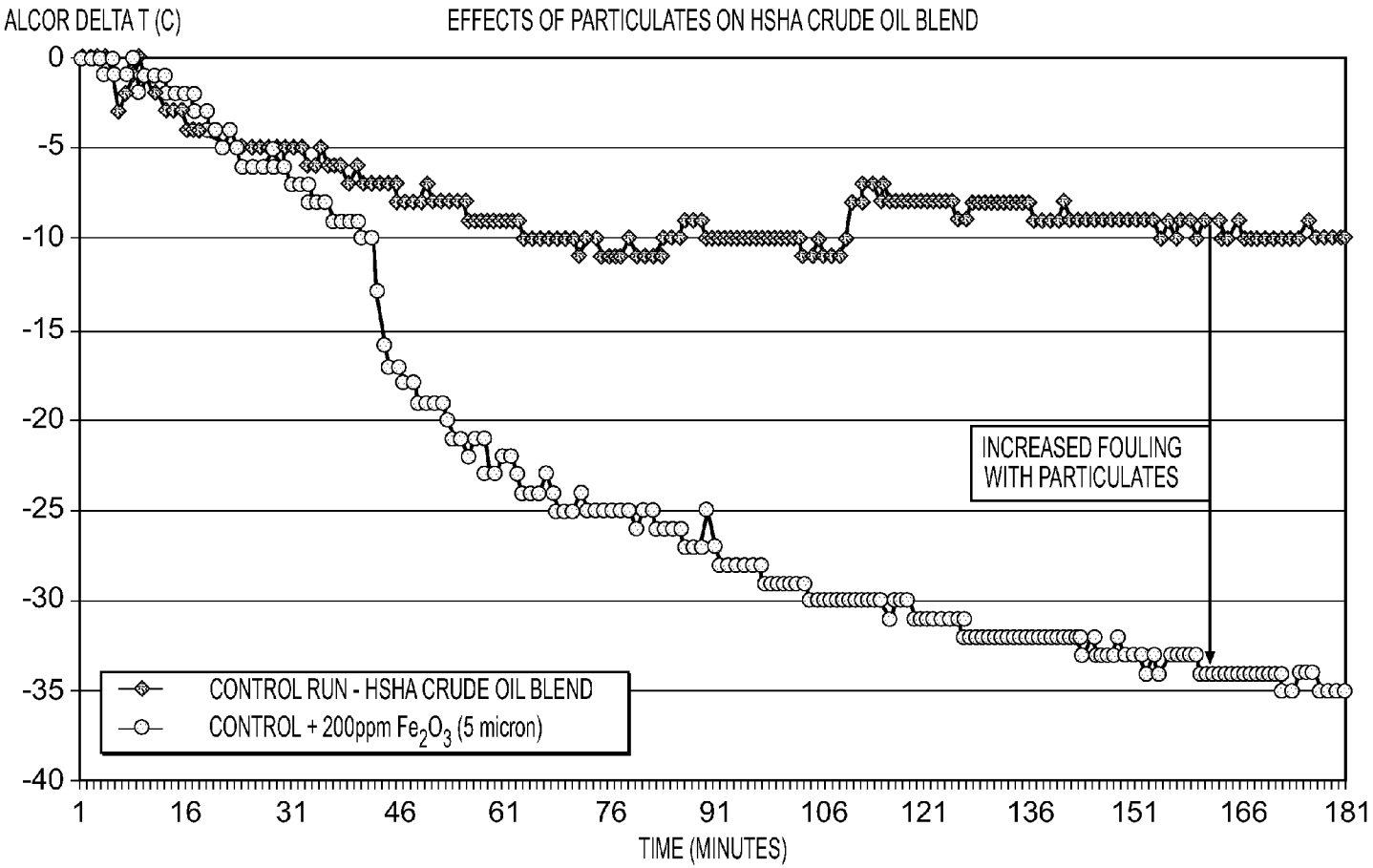
FIG. 3 is a graph illustrating the effects of particulates on fouling of a high-sulfur, high asphaltene (HSHA) crude oil blend.

An Alcor fouling simulation system was used to test the impact that the presence of particulates in a crude oil has on fouling of a refinery component or unit. Two streams were tested in the Alcor unit: a crude oil control and the same crude oil with 200 ppm by weight of iron oxide ($Fe_2O_3$) particles. As illustrated in FIGS. 2 and 3, there is an increase in fouling in the presence of iron oxide ($Fe_2O_3$) particles when compared to similar crude oils that do not contain particulates. For purpose of example and not limitation, two crude oils were tested as examples of base crude oils, a low-sulfur, low asphaltene or LSLA whole crude oil and a high-sulfur, high asphaltene or HSHA crude oil. These oils were selected as being representative of certain classifications of crude oil. The use of these crude oils is for illustrative purposes only, and the disclosed subject matter is not intended to be limited to application only with LSLA crude oil and HSHA crude oil. In fact, it is intended that the disclosed subject matter has application with all whole and blended crude oils and formulations of the same that experience and/or produce fouling in refinery components.

Example 2

Figure 4:
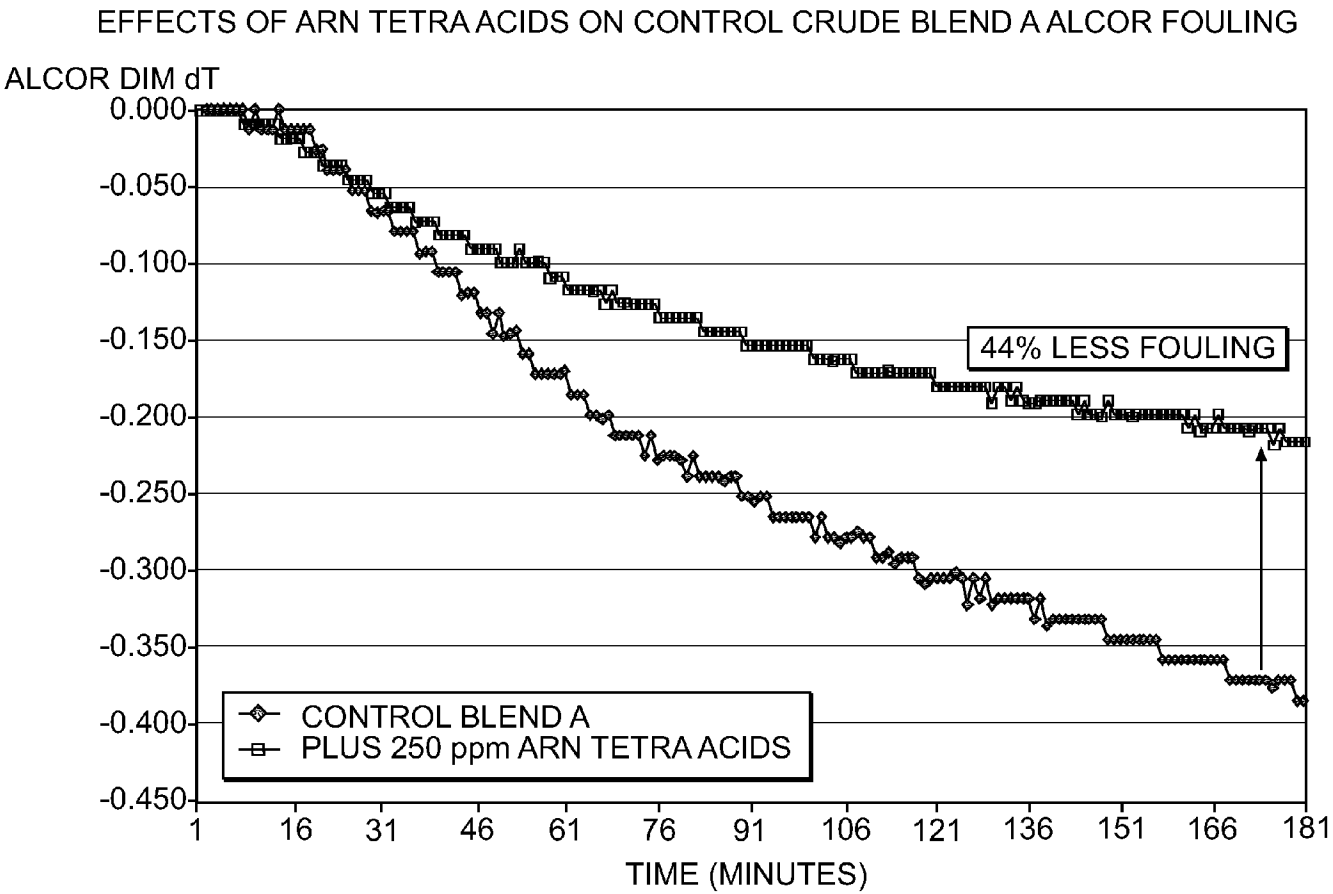
FIG. 4 is a graph illustrating the effects on fouling of a crude oil blend with particulates when an effective amount of a high-molecular weight naphthenic tetra-acid is added to the blend.

An Alcor fouling simulation system described above in Example 1 and illustrated in FIG. 1, was used to determine the effect the addition of high molecular weight naphthenic tetra-acid, particularly an ARN tetra-acid, has on the fouling of the base oil. Two streams were tested in the Alcor unit: a blend of crude oils A and B containing 200 ppm by weight of iron oxide ($Fe_2O_3$) particles as the "Control Blend A" and the same stream with approximately 150 ppm by weight of a high molecular weight naphthenic tetra-acids, specifically ARN tetra acids. As illustrated in FIG. 4, the reduction in the outlet temperature over time (due to fouling) is less from the process stream containing 250 ppm by weight of high molecular weight naphthenic tetra-acids, specifically ARN tetra acids as compared to crude oil control blend without the tetra-acids. As illustrated in FIG. 4, the high molecular weight naphthenic tetra-acid, specifically ARN tetra acids were effective in reducing fouling. Particularly, the ARN tetra acids were effective in significantly reducing fouling in streams that contact iron oxide particulates. As depicted in FIG. 4, the addition of the high molecular weight naphthenic tetra-acids reduced fouling by 44 percent.

While the disclosed subject matter has been described with reference to one or more particular embodiments, those skilled in the art will recognize that many changes can be made thereto without departing from the spirit and scope of the disclosed subject matter. Each of these embodiments and obvious variations thereof is contemplated as falling within the spirit and scope of the claimed invention, which is set forth in the following claims. The invention is therefore to be limited only by the terms of the appended claims along with the full scope of equivalents to which the claims are entitled.

What is claimed is:

1. A method for reducing fouling in a crude oil refinery component, comprising:

providing a base crude oil;

providing a high molecular weight ARN naphthenic tetra-acid;

adding an effective amount from about 50 and about 1000 parts per million by weight (wppm) of the high molecular weight ARN naphthenic tetra-acid to the base crude oil to form a crude oil mixture; and feeding the crude oil mixture to a crude oil refinery component.

2. The method of claim 1, wherein the base crude oil is a high neutralization number (HNN) crude oil.

3. The method of claim 1, wherein the ARN acids have molecular weights ranging from about 1228 to about 1236 atomic mass units (amu).

4. The method of claim 1, wherein the ARN acids have atomic molecular weights greater than about 1230 atomic mass units (amu).

5. The method of claim 1, wherein the ARN acid is an archaeal C80 isoprenoid having the following representative structure:

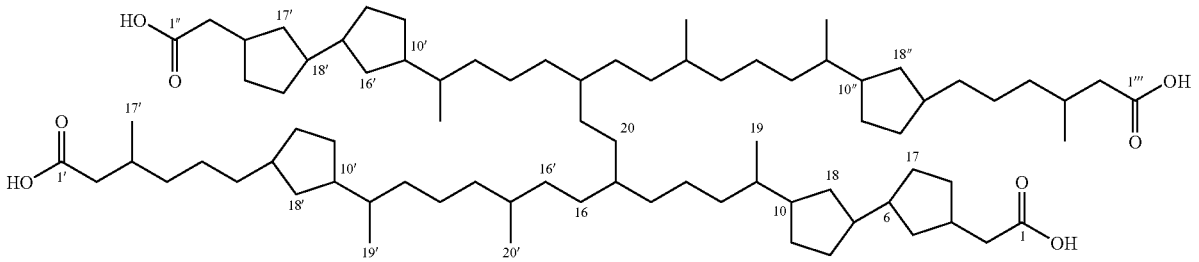

$C_{80}H_{142}O_8$
1231.070472

↓

$[C_{80}H_{141}O_8]^-$
1230.062647

6. The method of claim 1, wherein the base crude oil is a whole crude oil or a blend of at least two crude oils.

7. The method of claim 1, wherein the base crude oil comprises particulates.

8. The method of claim 7, wherein the crude oil mixture comprising the effective amount of the high molecular weight naphthenic tetra-acid prevents the particulates in the base crude oil from adhering to a surface of the crude oil refinery component.

9. The method of claim 1, wherein the addition of the effective amount of the high molecular weight naphthenic tetra-acid to the base crude oil reduces fouling by at least about 30 percent.

10. The method of claim 1, wherein the crude oil refinery component is selected from: heat exchanger, furnace, distillation column, scrubber, reactor, liquid-jacketed tank, pipestill, coker and visbreaker.

11. The method of claim 1, wherein the high molecular weight naphthenic tetra-acid is contained in a blending crude oil, and adding the effective amount of the high molecular weight ARN naphthenic tetra-acid to the base crude oil to form a crude oil mixture includes blending the base crude oil with the blending crude oil.

12. A method for on-line cleaning of a fouled crude oil refinery component, comprising:

operating a fouled crude oil refinery component; and feeding a crude oil mixture to the fouled crude oil refinery component, the crude oil mixture comprising:

a base crude oil; and an effective amount from about 50 and about 1000 parts per million by weight (wppm) of a high molecular weight ARN naphthenic tetra-acid.

13. The method of claim 12, wherein the crude oil refinery component is selected from: heat exchanger, furnace, distillation column, scrubber, reactor, liquid-jacketed tank, pipestill, coker and visbreaker.

14. The method of claim 12, wherein the effective amount of high molecular weight naphthenic tetra-acid is contained in a blending crude oil, and the crude oil mixture comprising a blend of the base crude oil and the blending crude oil.

* * * * *